US011441440B2

(12) United States Patent
Pratt et al.

(10) Patent No.: US 11,441,440 B2
(45) Date of Patent: Sep. 13, 2022

(54) ROTOR ASSEMBLY

(71) Applicant: Raytheon Technologies Corporation, Farmington, CT (US)

(72) Inventors: William S. Pratt, West Hartford, CT (US); Christopher J. Knortz, West Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/859,569

(22) Filed: Apr. 27, 2020

(65) Prior Publication Data

US 2021/0332711 A1 Oct. 28, 2021

(51) Int. Cl.

| | |
|---|---|
| ***F01D 11/00*** | (2006.01) |
| ***F01D 5/30*** | (2006.01) |
| ***F01D 5/08*** | (2006.01) |

(52) U.S. Cl.

CPC ..... *F01D 11/001* (2013.01); *F01D 5/3007* (2013.01); *F01D 5/3015* (2013.01); *F01D 5/082* (2013.01); *F01D 11/006* (2013.01); *F05D 2220/323* (2013.01); *F05D 2230/60* (2013.01); *F05D 2240/12* (2013.01); *F05D 2240/30* (2013.01); *F05D 2240/55* (2013.01); *F05D 2240/80* (2013.01); *F05D 2260/30* (2013.01)

(58) Field of Classification Search

CPC ..... F01D 11/006; F01D 5/30; F01D 5/3007; F01D 5/3015

See application file for complete search history.

(56) References Cited

U.S. PATENT DOCUMENTS 2,751,189 A * 6/1956 Ledwith ..... F01D 5/3007 416/217
5,639,212 A * 6/1997 Schaefer ..... F04D 29/563 415/173.7

(Continued)

FOREIGN PATENT DOCUMENTS

| | | |
|---|---|---|
| EP | 2604799 A1 | 6/2013 |
| GB | 987839 A | 3/1965 |

OTHER PUBLICATIONS

EP search report for EP21160036.6 dated Sep. 13, 2021.

*Primary Examiner* — Courtney D Heinle
*Assistant Examiner* — Michael K. Reitz
(74) *Attorney, Agent, or Firm* — Getz Balich LLC

(57) ABSTRACT

A rotor assembly for a piece of rotational equipment includes a rotor disk configured to rotate about a rotational axis. The rotor disclose includes a first rotor attachment member including a first mount slot and a second rotor attachment member including a second mount slot. The rotor disk further includes an outer diameter surface extending between the first rotor attachment member and the second rotor attachment member. The rotor assembly further includes a rotor blade including an airfoil, a platform, a first mount portion retained within the first mount slot, and a second mount portion retained within the second mount slot. The platform includes an inner platform surface facing the outer diameter surface. The rotor disk and the rotor blade define a circumferential portion of a circumferentially-extending cavity between the inner platform surface, the outer diameter surface, the first rotor attachment member, and the second rotor attachment member.

15 Claims, 17 Drawing Sheets

(56) References Cited

U.S. PATENT DOCUMENTS

| | | | | |
|---|---|---|---|---|
| 6,364,613 | B1 * | 4/2002 | Deallenbach | F01D 5/3053 416/220 R |
| 6,565,322 | B1 | 5/2003 | Lieser | |
| 6,575,704 | B1 * | 6/2003 | Tiemann | F01D 11/006 416/219 R |
| 8,038,405 | B2 | 10/2011 | Ward | |
| 9,175,573 | B2 | 11/2015 | Cairo | |
| 2010/0008769 | A1 * | 1/2010 | Arness | F01D 5/3007 415/174.2 |
| 2016/0123157 | A1 * | 5/2016 | Congratel | F01D 11/006 416/185 |
| 2019/0078454 | A1 * | 3/2019 | Rudolph | F01D 11/006 |

* cited by examiner

ROTOR ASSEMBLY

This invention was made with Government support awarded by the United States. The Government has certain rights in this invention.

BACKGROUND

1. Technical Field

This disclosure relates generally to rotational equipment and, more particularly, to sealing a joint between a rotor blade and a rotor disk.

2. Background Information

A rotor assembly for a gas turbine engine may include a plurality of rotor blades arranged around a rotor disk. Each rotor blade may be mounted to the rotor disk by a mechanical joint such as, for example, a dovetail interface. While various types and configurations of rotor assemblies are known in the art, there is still room in the art for improvement. In particular, there is need in the art for reducing fluid leakage through mechanical joints between rotor blades and a rotor disk.

SUMMARY

It should be understood that any or all of the features or embodiments described herein can be used or combined in any combination with each and every other feature or embodiment described herein unless expressly noted otherwise.

According to an embodiment of the present disclosure, a rotor assembly for a piece of rotational equipment includes a rotor disk configured to rotate about a rotational axis. The rotor disclose includes a first rotor attachment member including a first mount slot and a second rotor attachment member including a second mount slot. The rotor disk further includes an outer diameter surface extending between the first rotor attachment member and the second rotor attachment member. The rotor assembly further includes a rotor blade including an airfoil, a platform, a first mount portion retained within the first mount slot, and a second mount portion retained within the second mount slot. The platform includes an inner platform surface facing the outer diameter surface. The rotor disk and the rotor blade define a circumferential portion of a circumferentially-extending cavity between the inner platform surface, the outer diameter surface, the first rotor attachment member, and the second rotor attachment member.

In the alternative or additionally thereto, in the foregoing embodiment, each of the first rotor attachment member and the second rotor attachment member extend radially outward from the outer diameter surface of the rotor disk to respective first and second distal ends adjacent the inner platform surface of the platform.

In the alternative or additionally thereto, in the foregoing embodiment, the first mount slot and the second mount slot extend a first radial distance from the respective first and second distal ends toward the outer diameter surface of the rotor disk and the first mount slot and the second mount slot are spaced from the outer diameter surface of the rotor disk by a second radial distance.

In the alternative or additionally thereto, in the foregoing embodiment, the circumferentially-extending cavity includes an axial width extending from the first rotor attachment member to the second rotor attachment member and a radial height extending from the outer diameter surface of the rotor disk to the inner platform surface of the platform.

In the alternative or additionally thereto, in the foregoing embodiment, the rotor assembly further includes a seal disposed within the circumferentially-extending cavity.

In the alternative or additionally thereto, in the foregoing embodiment, the seal includes at least one sealing ring disposed about the rotational axis.

In the alternative or additionally thereto, in the foregoing embodiment, the at least one sealing ring is biased in a radially outward direction.

In the alternative or additionally thereto, in the foregoing embodiment, the at least one sealing ring is in contact with the inner platform surface of the platform and a cavity-facing surface of one or both of the first rotor attachment member and the second rotor attachment member.

In the alternative or additionally thereto, in the foregoing embodiment, the at least one sealing ring includes a first sealing ring and a second sealing ring axially adjacent the first sealing ring.

In the alternative or additionally thereto, in the foregoing embodiment, the first sealing ring is axially spaced from the second sealing ring.

In the alternative or additionally thereto, in the foregoing embodiment, the inner platform surface of the platform includes two axially-adjacent recesses. The first sealing ring is disposed in a first recess of the two axially-adjacent recesses and the second sealing ring is disposed in a second recess of the two axially-adjacent recesses.

In the alternative or additionally thereto, in the foregoing embodiment, the first sealing ring and the second sealing ring axially overlap one another.

In the alternative or additionally thereto, in the foregoing embodiment, the inner platform surface of the platform includes a recess extending axially between the first mount and the second mount. The first sealing ring and the second sealing ring are disposed in the recess.

According to another embodiment of the present disclosure, a compressor for a gas turbine engine includes a stator assembly including at least one circumferential row of stator vanes. The compressor further includes a rotor assembly configured to rotate relative to the stator assembly about a longitudinal centerline of the gas turbine engine. The rotor assembly includes a rotor disk including a first rotor attachment member including a first mount slot and a second rotor attachment member including a second mount slot. The rotor disk further includes an outer diameter surface extending between the first rotor attachment member and the second rotor attachment member. The rotor assembly further includes a rotor blade including an airfoil, a platform, a first mount retained within the first mount slot, and a second mount retained within the second mount slot. The platform includes an inner platform surface facing the outer diameter surface. The rotor disk and the rotor blade define a circumferential portion of a circumferentially-extending cavity between the inner platform surface, the outer diameter surface, the first rotor attachment member, and the second rotor attachment member.

In the alternative or additionally thereto, in the foregoing embodiment, the rotor assembly further comprises a seal disposed within the circumferentially-extending cavity.

In the alternative or additionally thereto, in the foregoing embodiment, the seal includes at least one sealing ring disposed about the rotational axis.

In the alternative or additionally thereto, in the foregoing embodiment, the at least one sealing ring includes a first sealing ring and a second sealing ring axially adjacent the first sealing ring.

According to another embodiment of the present disclosure, a method for assembly a rotor assembly for a piece of rotational equipment includes radially inserting a rotor blade into a rotor disk including a first rotor attachment member including a first mount slot and a second rotor attachment member including a second mount slot. The rotor disk further includes an outer diameter surface extending between the first rotor attachment member and the second rotor attachment member. The method further includes axially inserting a first mount of the rotor blade into the first mount slot and a second mount of the rotor blade into the second mount slot. The rotor blade including an airfoil and a platform including an inner platform surface facing the outer diameter surface. The rotor disk and the rotor blade define a circumferential portion of a circumferentially-extending cavity between the inner platform surface, the outer diameter surface, the first rotor attachment member, and the second rotor attachment member.

In the alternative or additionally thereto, in the foregoing embodiment, the method further includes inserting a seal into the circumferentially-extending cavity before the step of radially inserting the rotor blade into the rotor disk. The seal includes a first sealing ring and a second sealing ring axially adjacent the first sealing ring within the circumferentially-extending cavity.

In the alternative or additionally thereto, in the foregoing embodiment, the method further includes axially and radially compressing the first sealing ring and the second sealing ring after the step of inserting the seal into the circumferentially-extending cavity and before the step of radially inserting the rotor blade into the rotor disk.

The present disclosure, and all its aspects, embodiments and advantages associated therewith will become more readily apparent in view of the detailed description provided below, including the accompanying drawings.

DETAILED DESCRIPTION

Figure 1:
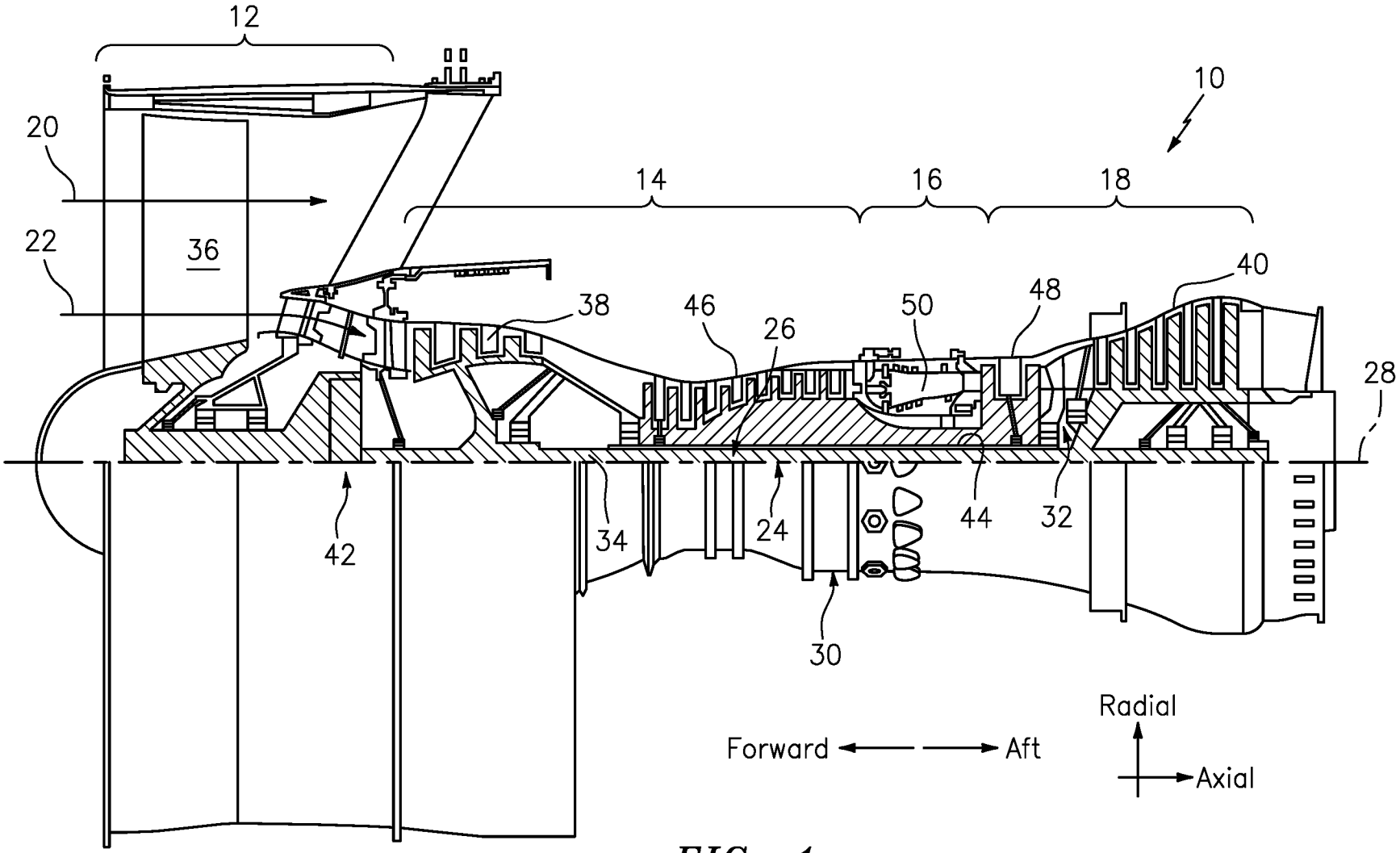
FIG. 1 illustrates a side cutaway view of a gas turbine engine, in accordance with one or more embodiments of the present disclosure.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Referring to FIG. 1, an exemplary gas turbine engine 10 is schematically illustrated. The gas turbine engine 10 is disclosed herein as a two-spool turbofan engine that generally includes a fan section 12, a compressor section 14, a combustor section 16, and a turbine section 18. The fan section 12 drives air along a bypass flow path 20 while the compressor section 14 drives air along a core flow path 22 for compression and communication into the combustor section 16 and then expansion through the turbine section 18. Although depicted as a turbofan gas turbine engine in the disclosed non-limiting embodiments, it should be understood that the concepts described herein are not limited to use with turbofans as the teachings may be applied to other types of turbine engines including those with three-spool architectures.

The gas turbine engine 10 generally includes a low-pressure spool 24 and a high-pressure spool 26 mounted for rotation about a longitudinal centerline 28 of the gas turbine engine 10 relative to an engine static structure 30 via one or more bearing systems 32. It should be understood that various bearing systems 32 at various locations may alternatively or additionally be provided.

The low-pressure spool 24 generally includes a first shaft 34 that interconnects a fan 36, a low-pressure compressor 38, and a low-pressure turbine 40. The first shaft 34 is connected to the fan 36 through a gear assembly of a fan drive gear system 42 to drive the fan 36 at a lower speed than the low-pressure spool 24. The high-pressure spool 26 generally includes a second shaft 44 that interconnects a high-pressure compressor 46 and a high-pressure turbine 48. It is to be understood that "low pressure" and "high pressure" or variations thereof as used herein are relative terms indicating that the high pressure is greater than the low pressure. An annular combustor 50 is disposed between the high-pressure compressor 46 and the high-pressure turbine 48 along the longitudinal centerline 28. The first shaft 34 and the second shaft 44 are concentric and rotate via the one or more bearing systems 32 about the longitudinal centerline 28 which is collinear with respective longitudinal centerlines of the first and second shafts 34, 44.

Airflow along the core flow path 22 is compressed by the low-pressure compressor 38, then the high-pressure compressor 46, mixed and burned with fuel in the combustor 50, and then expanded over the high-pressure turbine 48 and the low-pressure turbine 40. The low-pressure turbine 40 and the high-pressure turbine 48 rotationally drive the low-pressure spool 24 and the high-pressure spool 26, respectively, in response to the expansion.

Figure 2:
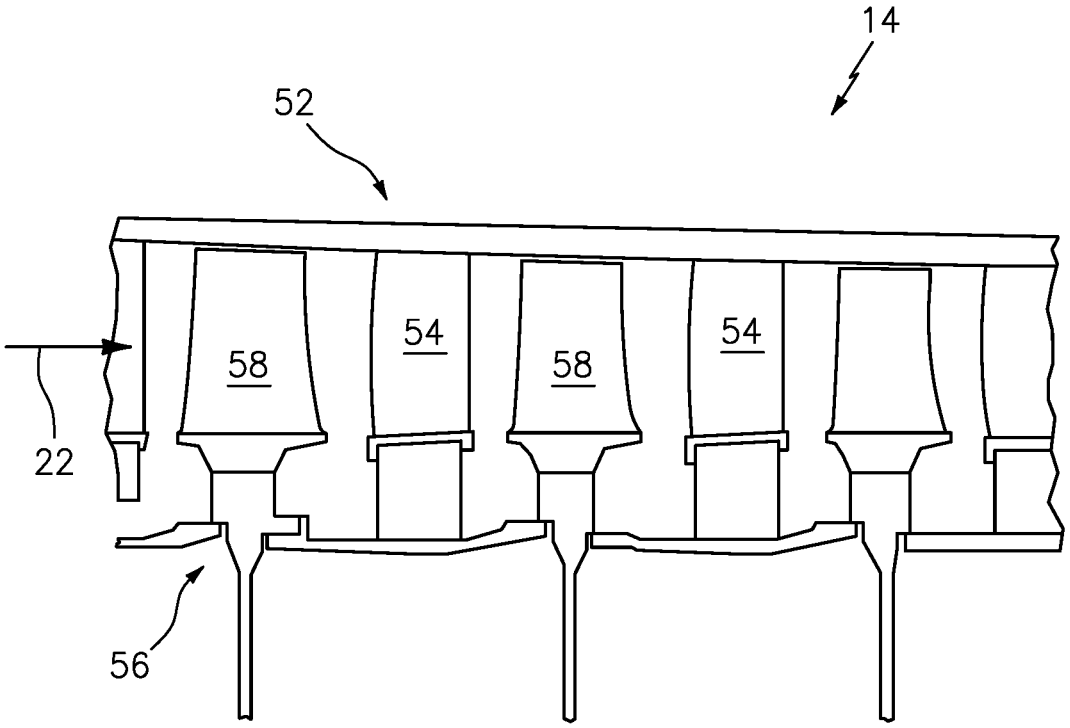
FIG. 2 illustrates a side cross-sectional view of a portion of an exemplary compressor section of the gas turbine engine of FIG. 1, in accordance with one or more embodiments of the present disclosure.

Referring to FIG. 2, a portion of the compressor section 14 of the gas turbine engine 10 is illustrated. The compressor section 14 includes a stator assembly 52 including a plurality of rows of stator vanes 54 which extend through the core flow path 22. The compressor section 14 further includes a bladed rotor assembly 56 including a plurality of rows of rotor blades 58 (e.g., compressor blades) which extend through the core flow path 22. The rotor assembly 56 is configured to rotate relative to the stator assembly 52.

Figure 3:
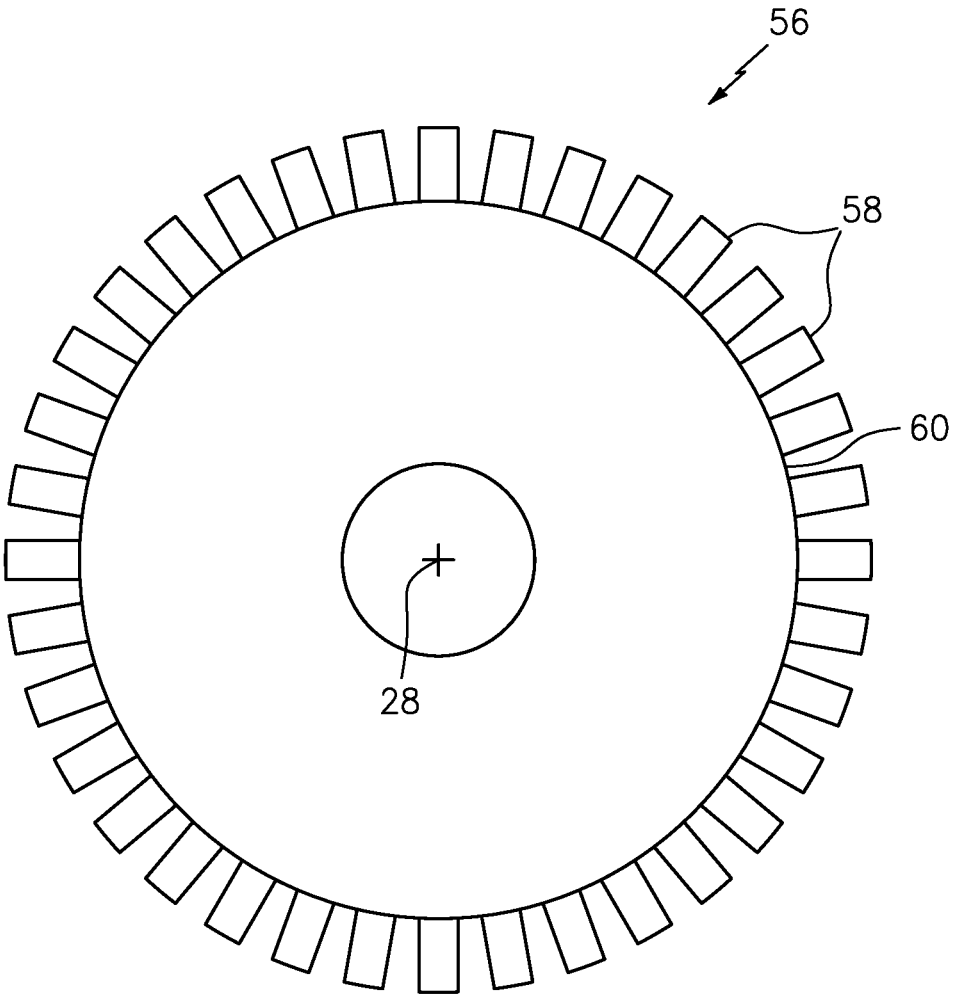
FIG. 3 illustrates a schematic view of a bladed rotor assembly, in accordance with one or more embodiments of the present disclosure.

Referring to FIG. 3, the rotor assembly 56 for a piece of rotational equipment is illustrated. As noted above, an example of such a piece of rotational equipment is a rotor assembly for use in a gas turbine engine for an aircraft propulsion system, an exemplary embodiment of which is described below in further detail with respect to FIGS. 1 and 2. However, the rotor assembly 56 of the present disclosure is not limited to such an aircraft application, a gas turbine engine application, or a compressor section application. The rotor assembly 56 for example, may alternatively be configured with rotational equipment such as an industrial gas turbine engine, wind turbine, water turbine, or any other apparatus which includes a bladed rotor.

Referring to FIGS. 3-10, the rotor assembly 56 includes a rotor disk 60 and the plurality of rotor blades 58. The rotor disk 60 is configured to rotate about a rotational axis which may be an axial centerline of the rotor assembly 56 and/or the piece of rotational equipment, for example, the longitudinal centerline 28 of the gas turbine engine 10.

Figure 4:
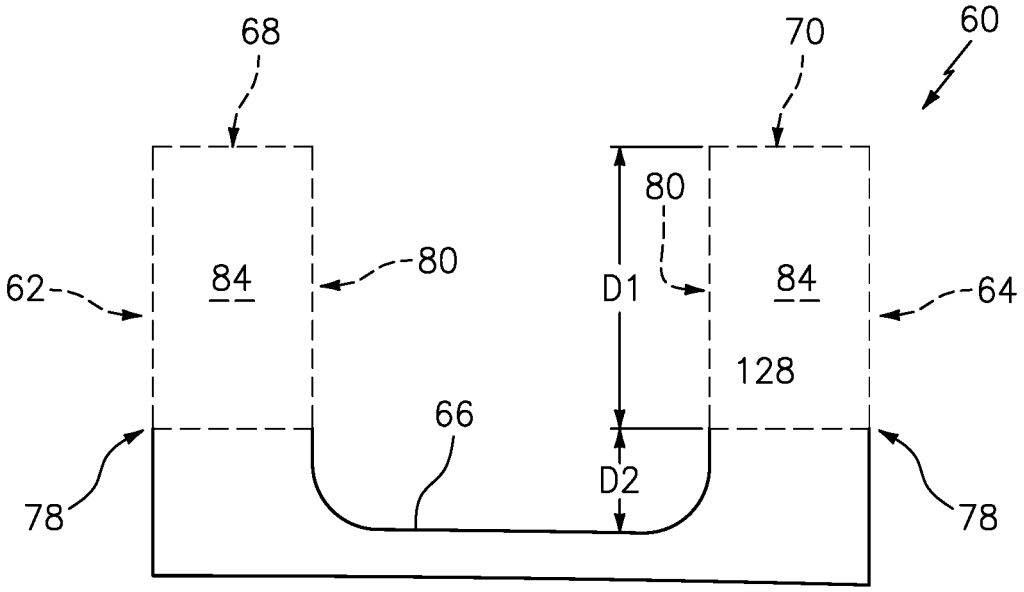
FIG. 4 illustrates a tangential cross-sectional view of a portion of a rotor disk, in accordance with one or more embodiments of the present disclosure.
Figure 5:
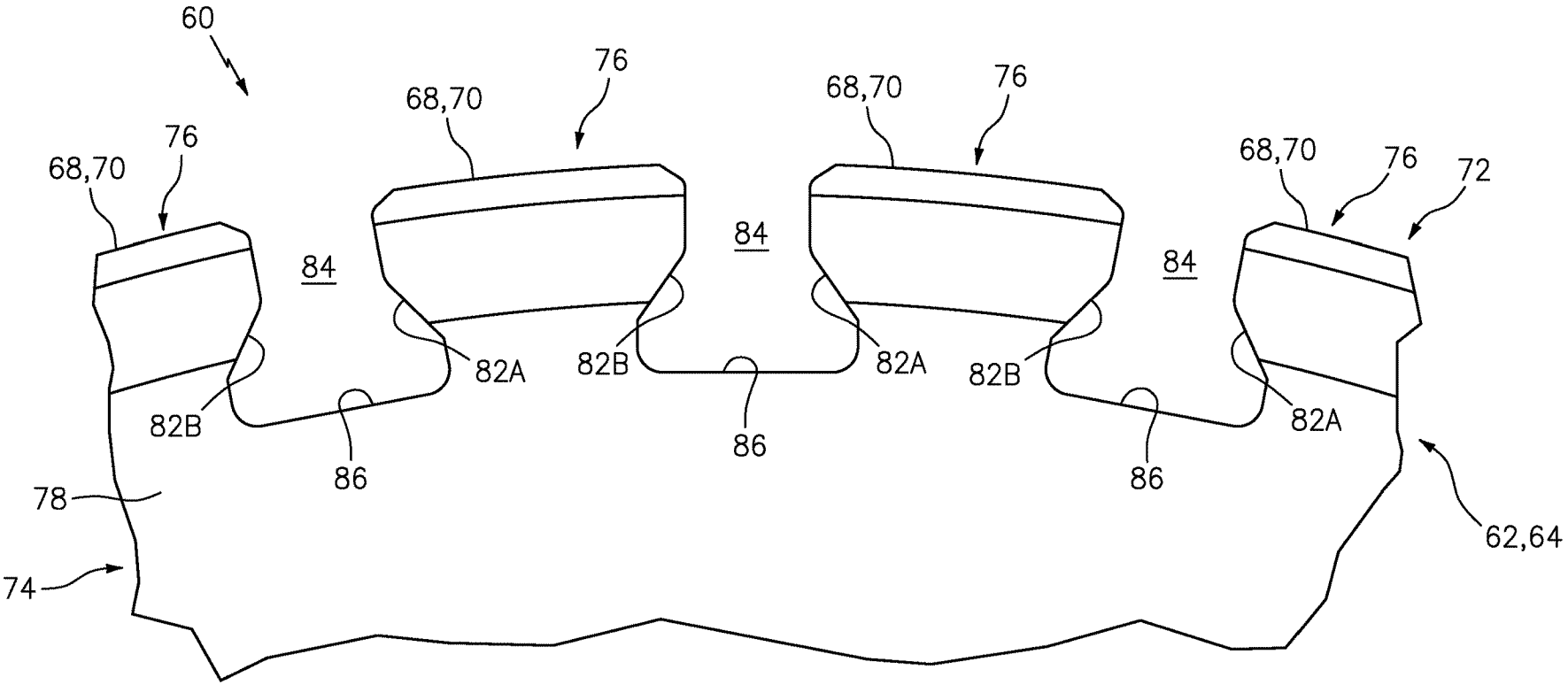
FIG. 5 illustrates a view of a circumferential portion the portion of the rotor disk of FIG. 4, in accordance with one or more embodiments of the present disclosure.

As shown in FIGS. 4 and 5, the rotor disk 60 includes a first rotor attachment member 62, a second rotor attachment member 64, and an outer diameter surface 66 extending in a generally axial direction between the first rotor attachment member 62 and the second rotor attachment member 64. Each of the first rotor attachment member 62 and the second rotor attachment member 64 extend radially outward from the outer diameter surface 66 of the rotor disk 60 to respective first and second distal ends 68, 70. Each of the first rotor attachment member 62 and the second rotor attachment member 64 includes a rim 72 at a radially outer periphery of the rotor disk 60. The rim 72 includes a rim base 74 and a plurality of rim lugs 76. The rim base 74 extends circumferentially about (e.g., completely around) the longitudinal centerline 28. The rim base 74 extends axially between a rim first end 78 of the rim 72 and a rim second end 80 of the rim 72.

The rim lugs 76 of are arranged circumferentially about the rim base 74 and the longitudinal centerline 28 in an annular array. Each of the rim lugs 76 projects radially, in an outward direction relative to the longitudinal centerline 28, from a radially outer periphery of the rim base 74 to the respective distal end 68, 70. Each of the rim lugs 76 extends laterally (e.g., in a circumferential or tangential direction relative to the longitudinal centerline 28) between opposing lug first and second side surfaces 82A and 82B (generally referred to as "82"). Each of the rim lugs 76 extends generally axially between the rim first end 78 and the rim second end 80.

The rim lugs 76 are circumferentially spaced about (e.g., completely around) the longitudinal centerline 28 so as to form an annular array of mount slots 84. Each of the mount slots 84 is disposed laterally between and formed by a circumferentially adjacent pair of the rim lugs 76 and their side surfaces 82. Each mount slot 84 may extend radially inward a radial distance D1 from the respective distal ends 68, 70 toward the outer diameter surface 66 to a slot end surface 86. Each mount slot 84 may be radially spaced from the outer diameter surface 66 of the rotor disk 60 by a radial distance D2. Each mount slot 84 extends laterally between a respective one of the lug first side surfaces 82A and an adjacent respective one of the lug second side surfaces 82B. Each mount slot 84 may extend (e.g., substantially) axially through (or axially into) the respective rotor attachment member 62, 64. The first rotor attachment member 62 and the second rotor attachment member 64 may include respective first and second mount slots 84A, 84B which correspond to one another. For example, the first and second mount slots 84A, 84B may be circumferentially aligned with one another.

Figure 6:
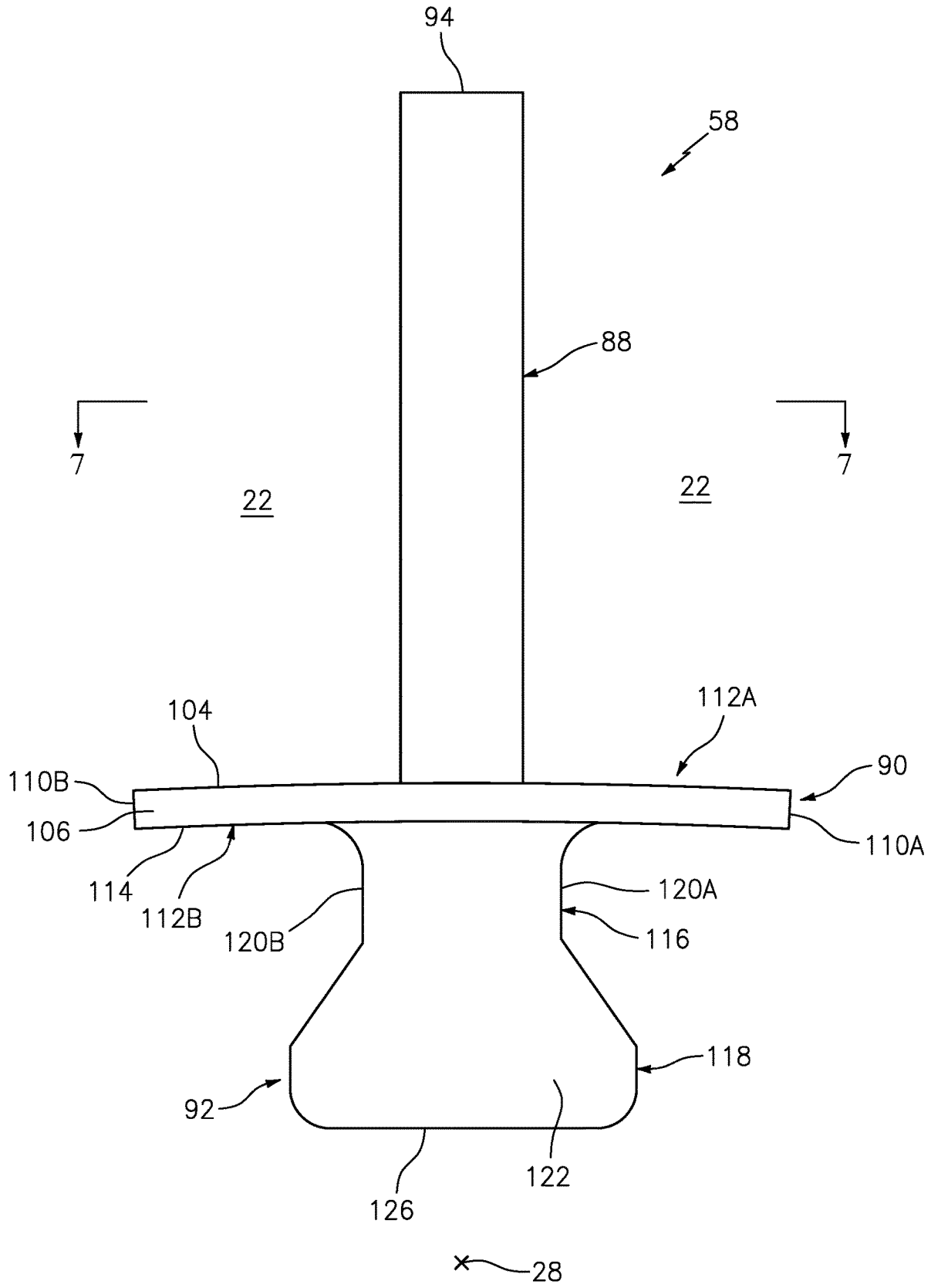
FIG. 6 illustrates a schematic view of a rotor blade, in accordance with one or more embodiments of the present disclosure.
Figure 7:
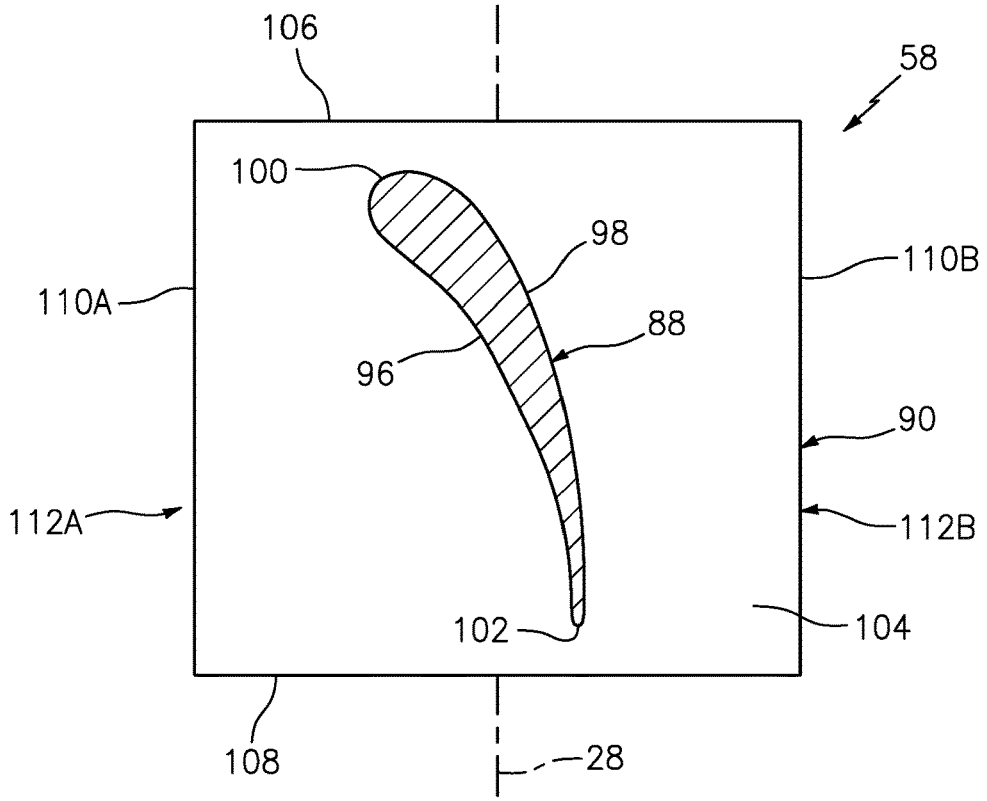
FIG. 7 illustrates a cross-sectional view of the rotor blade of FIG. 6 taken along Line 7-7, in accordance with one or more embodiments of the present disclosure.
Figure 8:
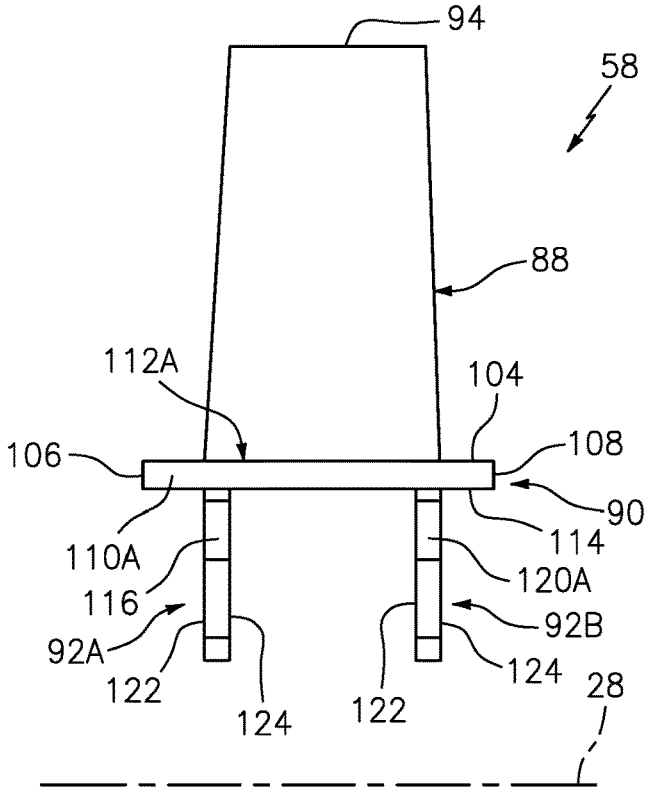
FIG. 8 illustrates a side view of the rotor blade of FIG. 6, in accordance with one or more embodiments of the present disclosure.

As shown in FIGS. 6-8, each rotor blade 58 includes an airfoil 88, a platform 90, and a mount 92 including a first (e.g., upstream and/or forward mount) mount 92A and a second (e.g., downstream and/or aft mount) mount 92B. The airfoil 88 projects radially outward from the platform 90 in a spanwise direction to a (e.g., unshrouded) airfoil tip 94. The airfoil 88 includes an airfoil first (e.g., pressure and/or concave) side surface 96 and an airfoil second (e.g., suction and/or convex) side surface 98. The airfoil first and second side surfaces 96, 98 extend along a chord line of the airfoil 88 between and meet at an airfoil (e.g., forward and/or upstream) leading edge 100 and an airfoil (e.g., aft and/or downstream) trailing edge 102.

The platform 90 is disposed radially between and connected to the airfoil 88 and the mount 92. The platform 90 is configured to form a portion of an inner peripheral border of a gas path (e.g., the core flow path 22) extending axially across the rotor assembly 56; e.g., a gas path into which the airfoils 88 of the rotor blades 58 radially extend. The rotor blade platform 90 includes an outer platform surface 104 that extends axially with respect to the longitudinal centerline 28 between a platform first (e.g., forward and/or upstream) end 106 and a platform second (e.g., aft and/or downstream) end 108. The outer platform surface 104 extends circumferentially between opposing platform first and second side ends 110A and 110B (generally referred to as "110").

The platform 90 is configured with a first side segment 112A (e.g., a side projection and/or wing) and a second side segment 112B (e.g., a side projection and/or wing), which segments 112A, 112B are generally referred to as "112". The first side segment 112A projects circumferentially away from the airfoil 88 and the mount 92 to the first side end 110A. The first side segment 112A is thereby cantilevered from the mount 92. The first side segment 112A extends radially between the outer platform surface 104 and an inner platform surface 114. The second side segment 112B projects circumferentially away from the airfoil 88 and the mount 92 to the second side end 110B. The second side segment 112B is thereby cantilevered from the mount 92. The second side segment 112B extends radially between the outer platform surface 104 and the inner platform surface 114. The inner platform surface 114 extends from the platform first end 106 to the platform second end 108

Each of the first and second mounts 92A, 92B include a mount neck 116 and a mount root 118. The mount neck 116 extends radially between and is connected to the platform 88 and the mount root 118. The mount neck 116 extends laterally between opposing first and second side surfaces 120A and 120B (generally referred to as "120"). The mount neck 116 extends (e.g., substantially) axially with respect to the longitudinal centerline 28 between a first (e.g., forward and/or upstream) end 122 of the respective mount 92A, 92B and a second (e.g., aft and/or downstream) end 124 of the respective mount 92A, 92B.

The mount root 118 extends (e.g., substantially) axially with respect to the longitudinal centerline 28 between the first end 122 of the respective mount 92A, 92B and the second end 124 of the respective mount 92A, 92B. The mount root 118 flares laterally outward from the mount neck 116 so as to form, for example, a "dovetail" attachment. The present disclosure, however, is not limited to such an exemplary attachment configuration. The mount root 118 projects radially inward from the mount neck 116 to a mount distal end surface 126; e.g., a mount bottom surface.

Figure 9:
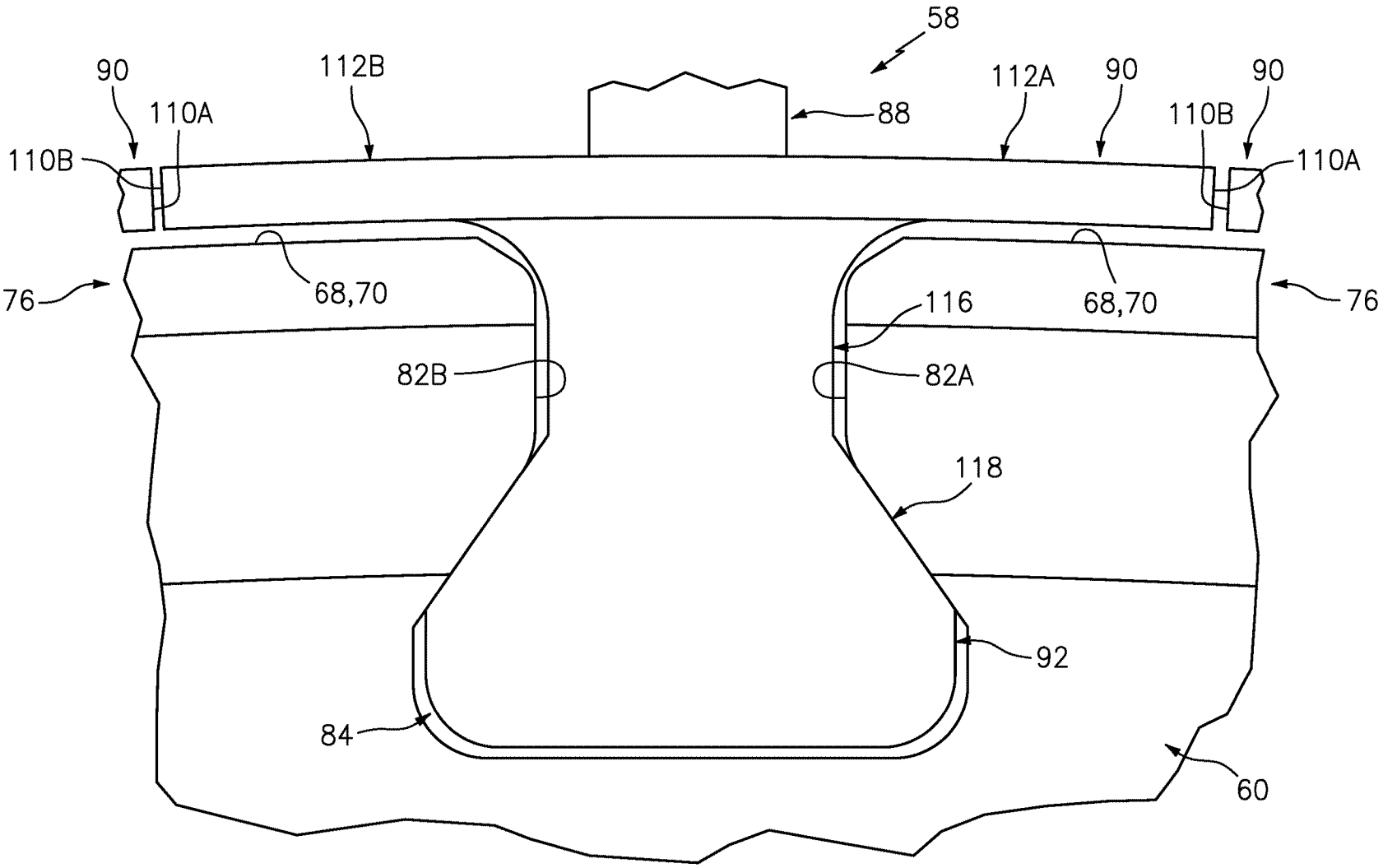
FIG. 9 illustrates a circumferential portion of an interface between a plurality of the rotor blades of FIG. 6 and the portion of the rotor disk of FIG. 5, where platforms of two of the rotor blades are partially shown, in accordance with one or more embodiments of the present disclosure.
Figure 10:
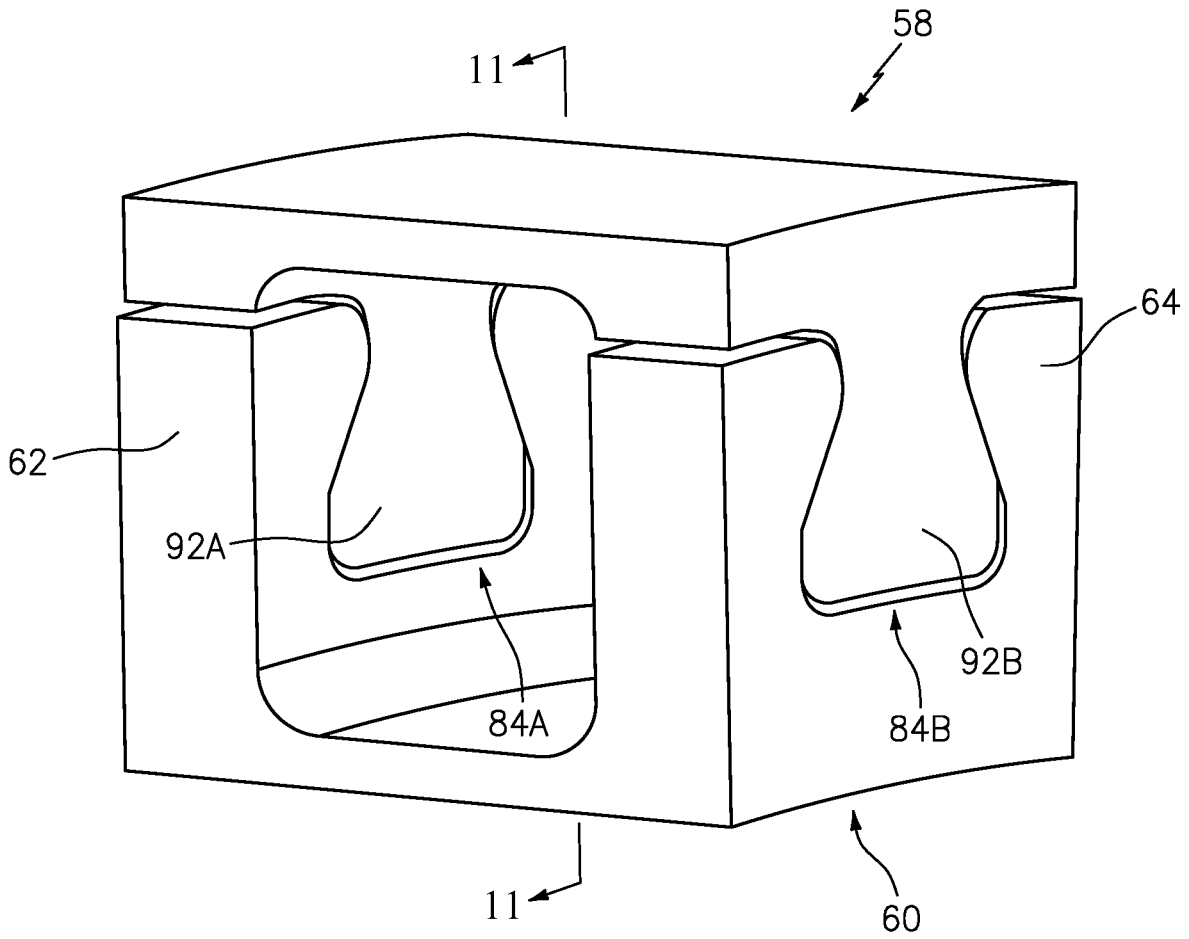
FIG. 10 illustrates a perspective view of a circumferential portion of the interface of FIG. 9, in accordance with one or more embodiments of the present disclosure.

As shown in FIGS. 9 and 10, the rotor blades 58 are arranged circumferentially around the rotor disk 60 and the longitudinal centerline 28 in an annular array. Each of the rotor blades 58 is attached to the rotor disk 60 via a mechanical joint; e.g., the mounts 92A, 92B. The mounts 92A, 92B of each rotor blade 58, for example, are mated with (e.g., slide into and seated within) a respective one of the mount slots 84A, 84B in the rotor disk 60. For example, the first mount 92A is retained within the first mount slot 84A and the second mount 92B is retained within the second mount slot 84B. The distal ends 68, 70 are disposed adjacent the inner platform surface 114 of the platform 90.

During rotational equipment operation and/or rotation of the rotor assembly 56 about its rotational axis, e.g., the longitudinal centerline 28, fluid (e.g., compressed air) may leak across the rotor assembly 56. For example, the fluid may leak axially through radial gaps between the rim lugs 76 and the rotor blade platforms 90. Fluid may additionally or alternatively leak axially through lateral gaps between the rim lugs 76 and the mounts 92A, 92B. Fluid may further additionally or alternatively leak radially through lateral gaps between the platform side ends 110. Such leakage may reduce performance of the rotational equipment, e.g., the compressor section 14 of the gas turbine engine 10.

Figure 11:
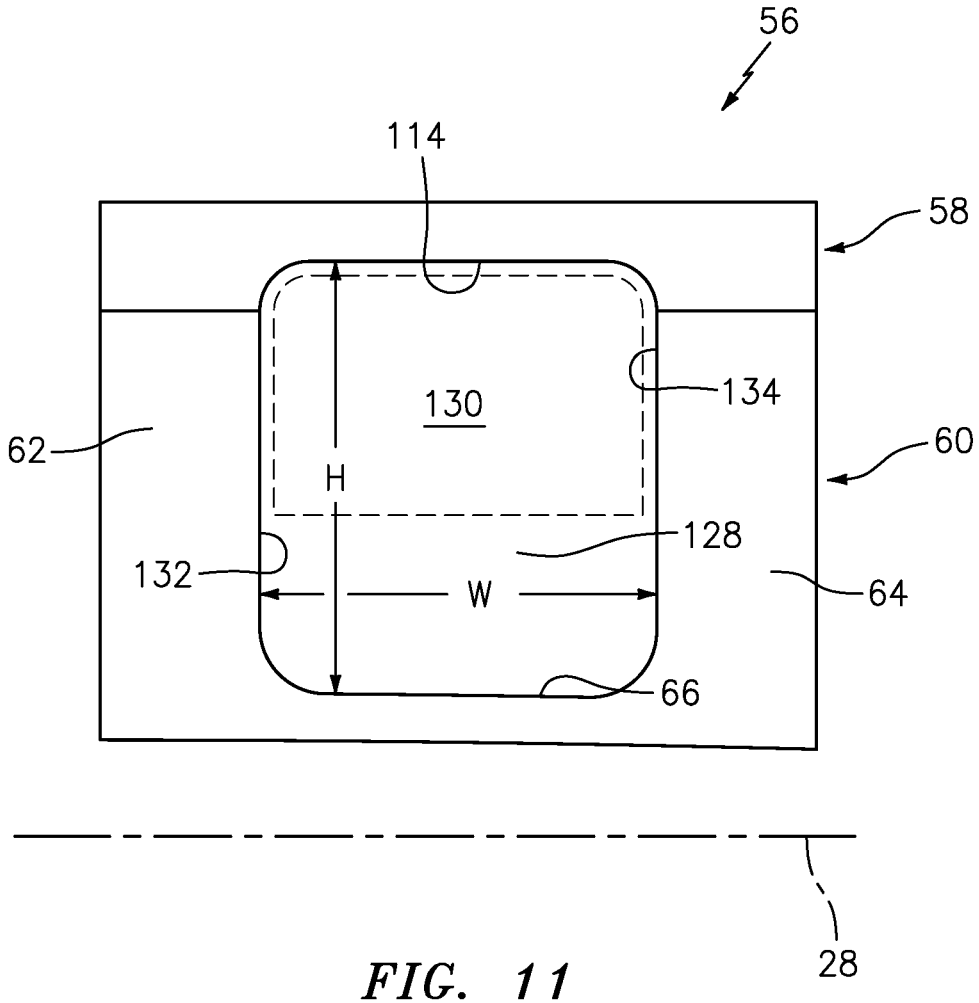
FIG. 11 illustrates a cross-sectional view of the interface of FIG. 9 taken along Line 11-11, in accordance with one or more embodiments of the present disclosure.

Referring to FIG. 11, in various embodiments, the rotor assembly 56 may include a cavity 128 extending circumferentially about (e.g., completely around) the rotational axis, e.g., the longitudinal centerline 28, of the rotor assembly 56. The cavity 128 may be associated with (e.g., axially aligned with) a circumferential row of the rotor blades 58. The rotor disk 60 and each rotor blade 58 may define a circumferential portion of the cavity 128. The cavity 128 may be defined between the inner platform surface 114, the outer diameter surface 66 of the rotor disk 60, the first rotor attachment member 62, and the second rotor attachment member 64. The cavity 128 may have an axial width W extending from the first rotor attachment member 62 to the second rotor attachment member 64. The cavity 128 may have a radial height H extending from the outer diameter surface 66 of the rotor disk 60 to the inner platform surface 114 of the platform 90.

In various embodiments, the rotor assembly 56 may include a seal 130 disposed within the cavity 128. The seal 130 may extend circumferentially about (e.g., completely around) the rotational axis, e.g., the longitudinal centerline 28, of the rotor assembly 56, within the cavity 128. The seal 130 may contact one or more of the surfaces which define the cavity 128. For example, the seal 130 may contact one or more of the outer diameter surface 66 of the rotor disk 60, the inner platform surface 114 of the platform 90, a cavity-facing surface 132 of the first rotor attachment member 62, and a cavity-facing surface 134 of the second rotor attachment member 64.

Referring to FIGS. 11-17, in various embodiments, the seal 130 may include at least one sealing ring disposed about the longitudinal centerline 28. For example, the seal 130 may include a first sealing ring 136, 136' and a second sealing ring 138, 138'. The first sealing ring 136, 136' and the second sealing ring 138, 138' may be axially adjacent one another within the cavity 130. One or both of the first sealing ring 136, 136' and the second sealing ring 138, 138' may have a split ring configuration. One or both of the first sealing ring 136, 136' and the second sealing ring 138, 138' may be biased in a radially outward direction. For example, one or both of the first sealing ring 136, 138' and the second sealing ring 138, 138' may be configured to expand in a radially outward direction so as to apply a force to the inner platform surface 114 of the platform 90.

Figure 12:
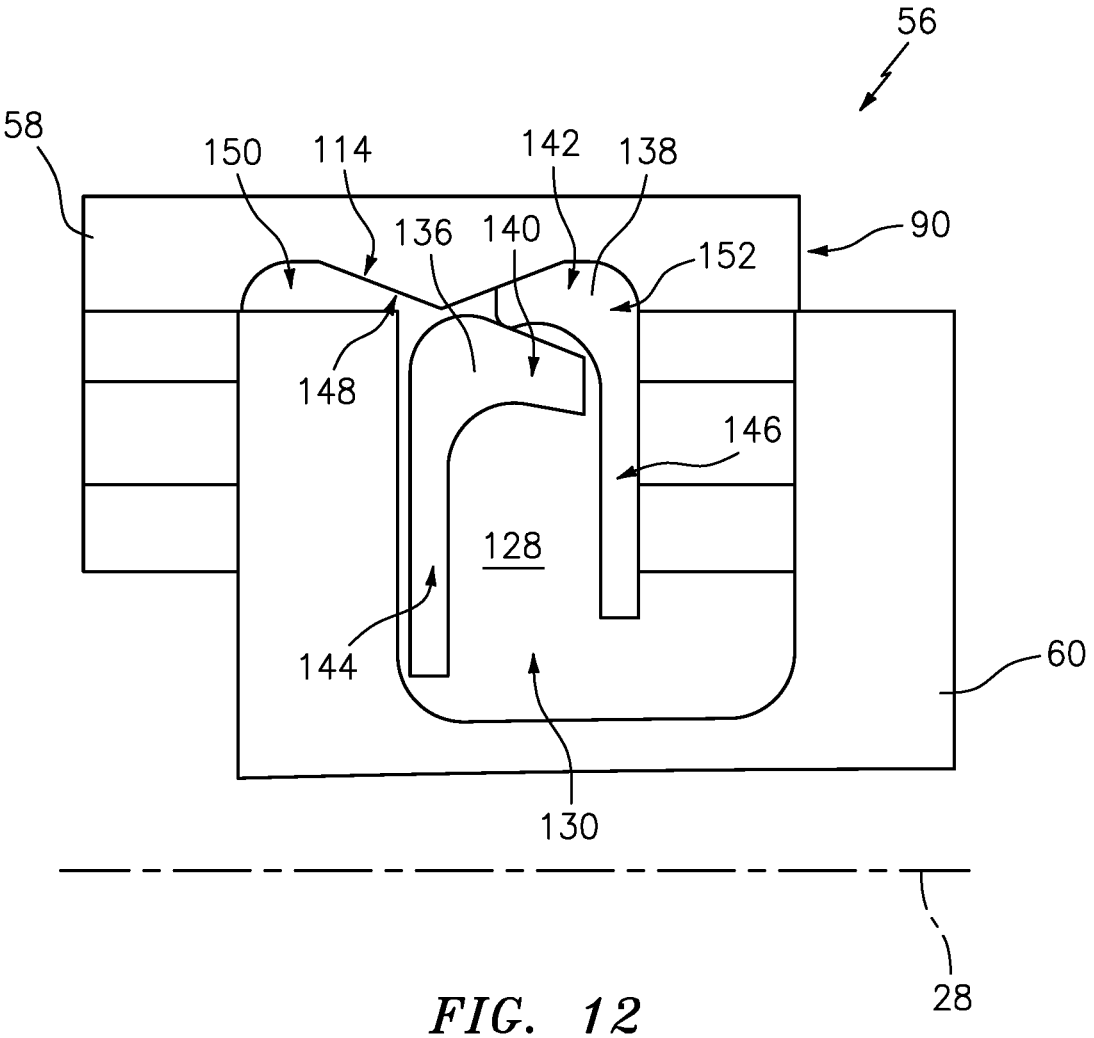
FIG. 12 illustrates the interface of FIG. 9 including an exemplary seal, in accordance with one or more embodiments of the present disclosure.
Figure 13:
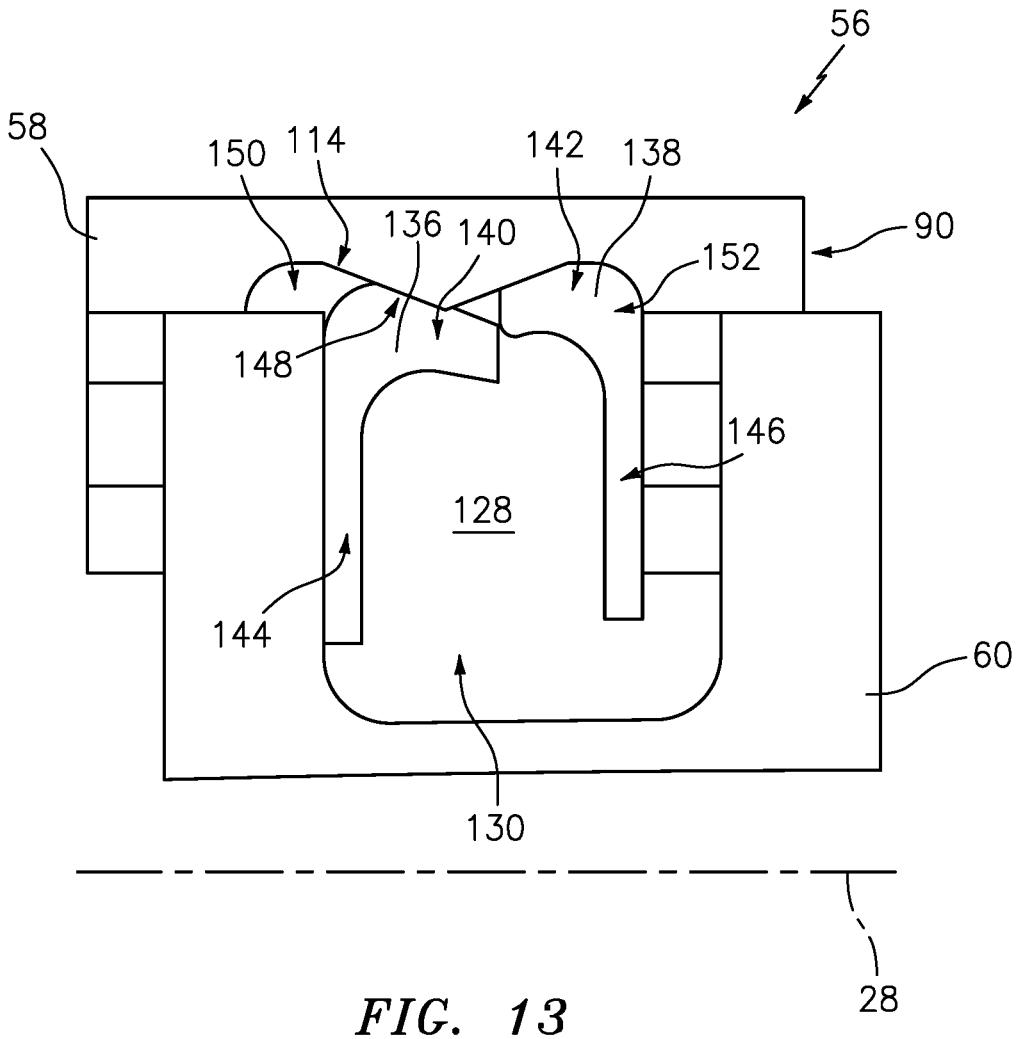
FIG. 13 illustrates the interface of FIG. 9 including the seal of FIG. 12, in accordance with one or more embodiments of the present disclosure.
Figure 14:
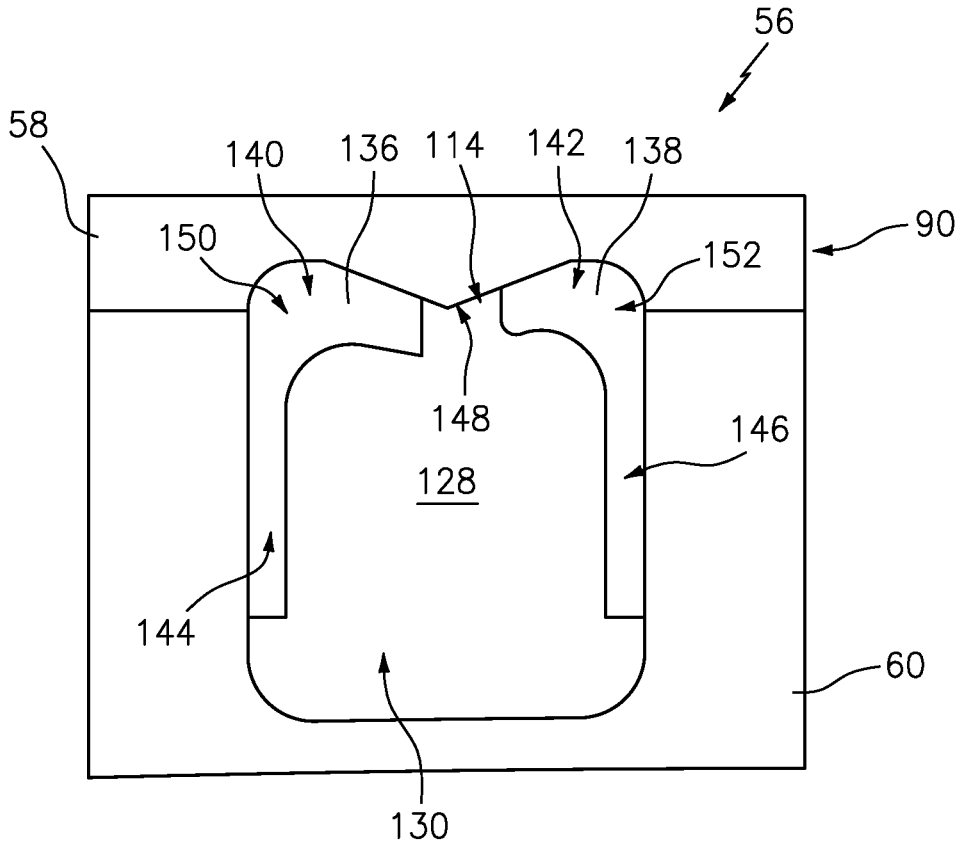
FIG. 14 illustrates the interface of FIG. 9 including the seal of FIG. 12, in accordance with one or more embodiments of the present disclosure.

Referring to FIGS. 12-14, in various embodiments, each of the first sealing ring 136 and the second sealing ring 138 may include respective axially-extending portions 140, 142 and radially-extending portions 144, 146. The first sealing ring 136 may be disposed axially forward of the second sealing ring 138 with the axially-extending portion 140 extending generally toward the second sealing ring 138. The second sealing ring 138 may be disposed axially aft of the first sealing ring 136 with the axially-extending portion 142 extending generally toward the first sealing ring 136.

The platform 90 may include a wedge member 148 which defines a portion of the inner platform surface 114. The wedge member 148 may extend in a circumferential direction from the first side end 110A to the second side end 110B of the platform 90. The wedge member 148 may, therefore, define and separate two axially-adjacent recesses 150, 152, each extending circumferentially along the platform 90. The axially-extending portion 140 of the first sealing ring 136 may have a shape which corresponds to a counterpart shape of the first axially-adjacent recess 150 and may be disposed in the first-axially-adjacent recess 150 when the rotor blade 58 is fully installed in the rotor disk 60 (see, e.g., FIG. 14). Similarly, the axially-extending portion 142 of the second sealing ring 138 may have a shape which corresponds to a counterpart shape of the second axially-adjacent recess 152 and may be disposed in the second axially-adjacent recess 152 when the rotor blade 58 is fully installed in the rotor disk 60 (see, e.g., FIG. 14). The first sealing ring 136 may be axially spaced from the second sealing ring 138, when the rotor blade 58 is fully installed in the rotor disk 60 (see, e.g., FIG. 14). As a result of the wedge member 148, centrifugal loads applied to the first and second sealing rings 136, 138, during rotational of the rotor disk 60, may translate into axial forces acting on the first and second sealing rings 136, 138 in an axially-forward direction and an axially-aft direction, respectively. The axial forces applied to the first and second sealing rings 136, 138 may serve to axially retain the rotor blades 58 in a properly installed position with respect to the rotor disk 60.

Figure 15:
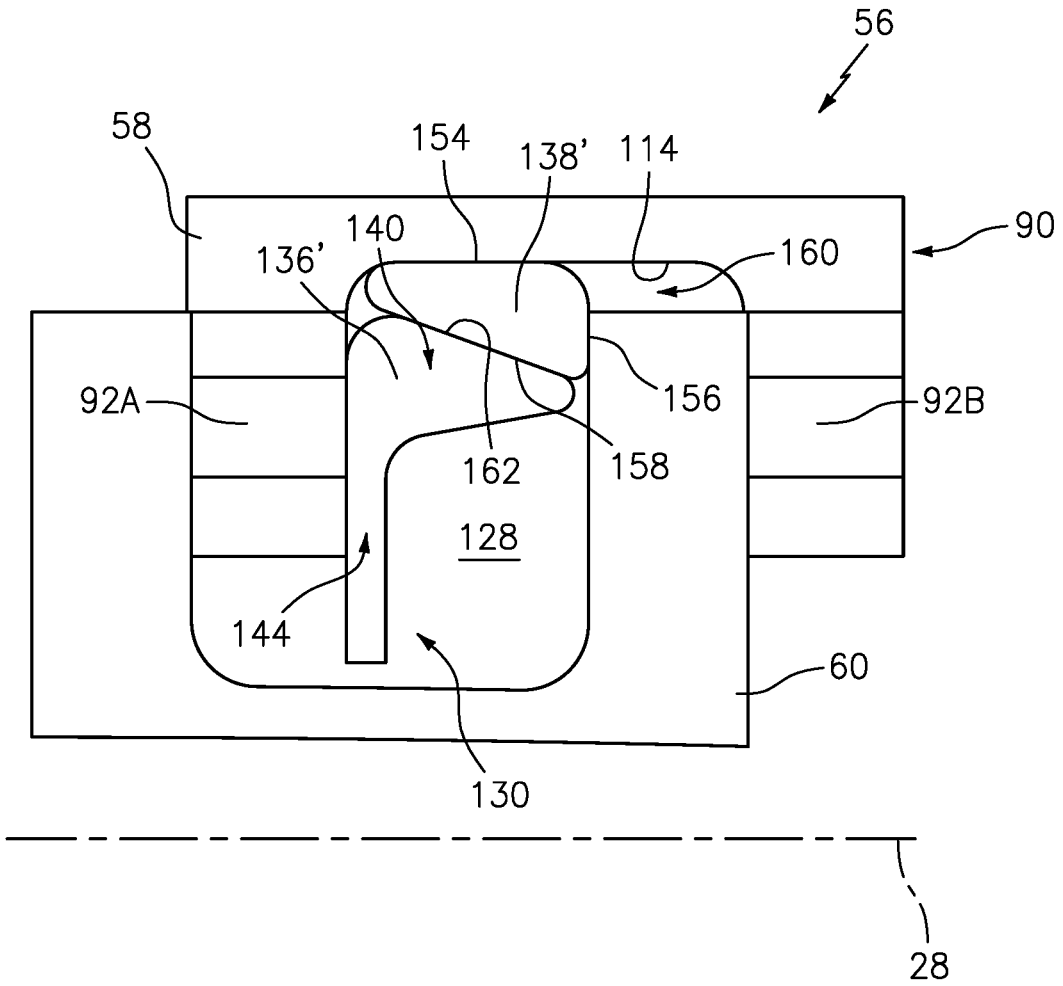
FIG. 15 illustrates the interface of FIG. 9 including an exemplary seal, in accordance with one or more embodiments of the present disclosure.
Figure 16:
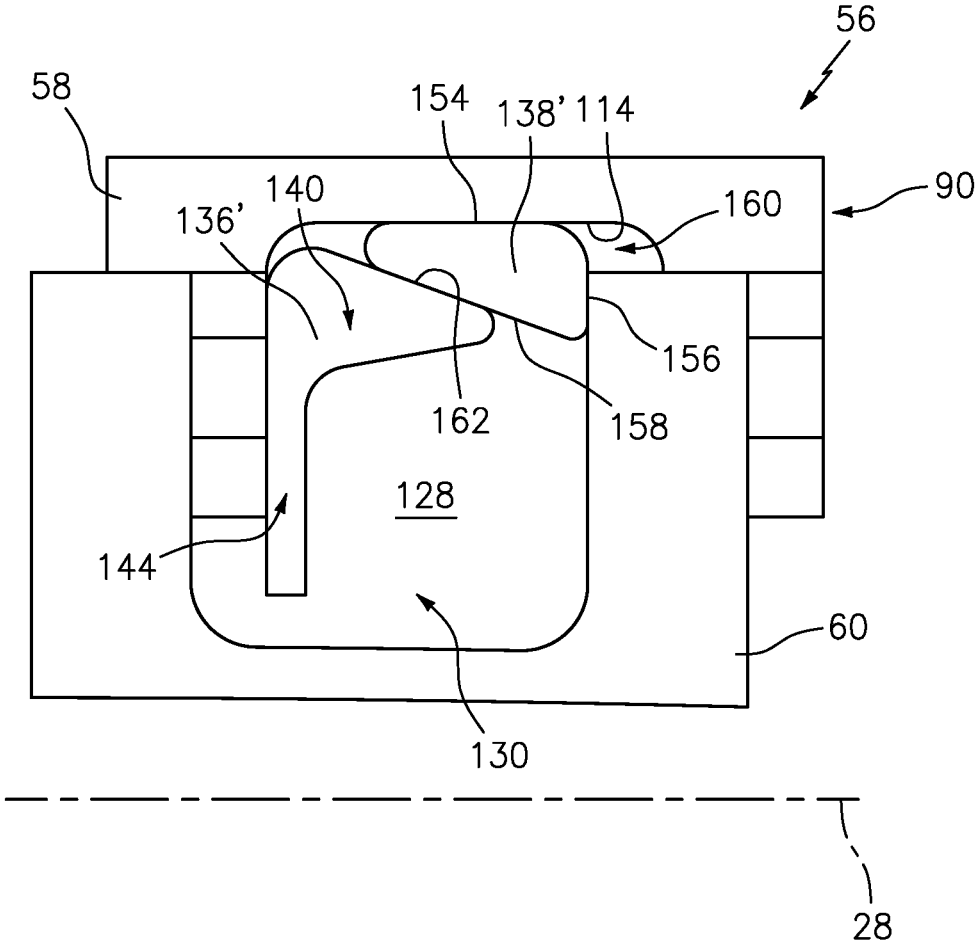
FIG. 16 illustrates the interface of FIG. 9 including the seal of FIG. 15, in accordance with one or more embodiments of the present disclosure.
Figure 17:
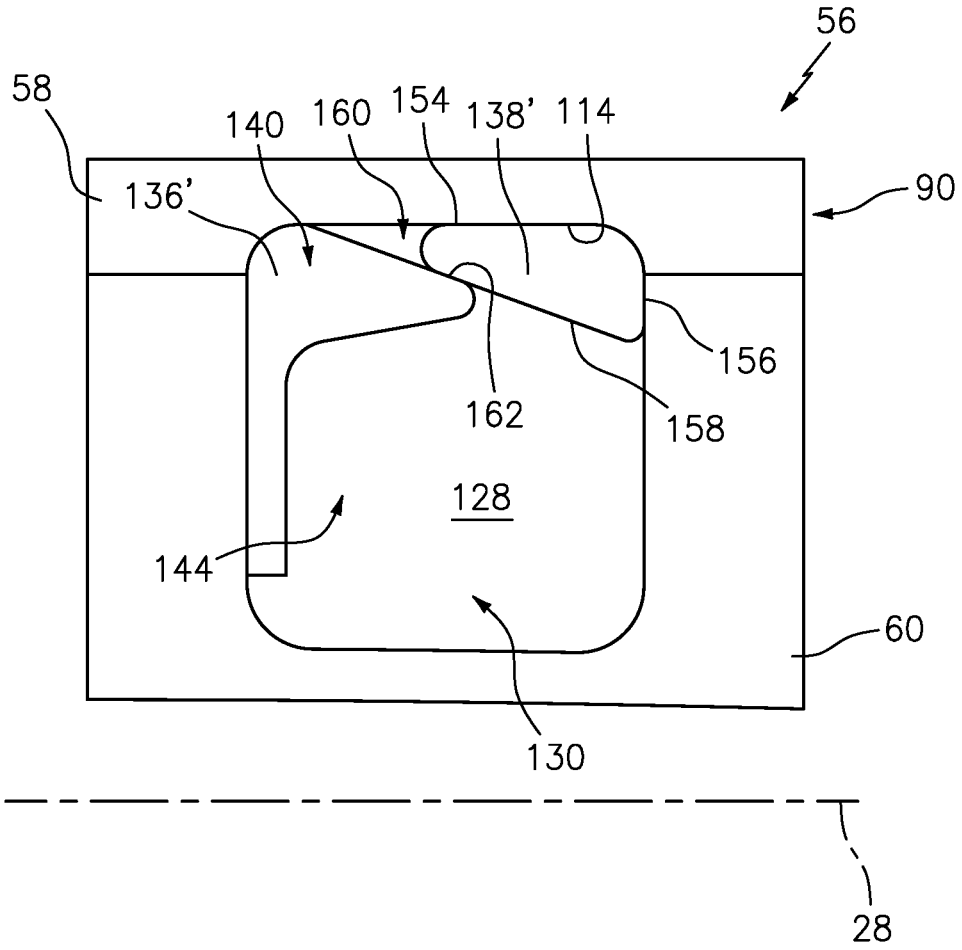
FIG. 17 illustrates the interface of FIG. 9 including the seal of FIG. 15, in accordance with one or more embodiments of the present disclosure.
Figure 18:
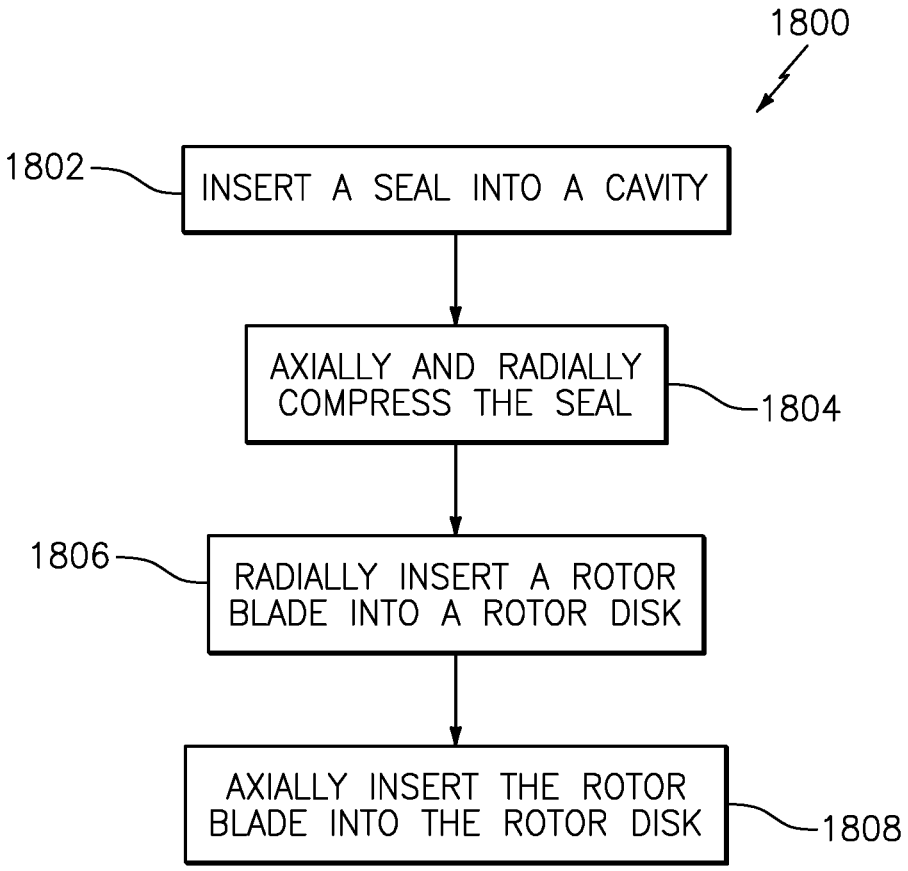
FIG. 18 illustrates a flowchart depicting a method for assembling a rotor assembly for a piece of rotational equipment, in accordance with one or more embodiments of the present disclosure.

Referring to FIGS. 15-17, in various embodiments, the first sealing ring 136' may include the axially-extending portion 140 and the radially-extending portion 144. A second sealing ring 138' may have a wedge cross-sectional shape. For example, the second sealing ring 138' may generally include an axially-extending surface 154, a radially-extending surface 156, and a first wedge surface 158 extending from the axially-extending surface 154 to the radially-extending surface 156. The axially-extending portion 140 of the first sealing ring 136' may include a second wedge surface 162 having an orientation which substantially corresponds to the orientation of the first wedge surface 158. For example, the first wedge surface 158 and the second wedge surface 162 may extend at a substantially same angle, with respect to the longitudinal centerline 28. The first sealing ring 136' may be disposed axially forward of the second sealing ring 138' with the axially-extending portion 140 extending generally toward the second sealing ring 138'. The second sealing ring 138' may be disposed axially aft of the first sealing ring 136. While the second sealing ring 138' is disclosed as being aft of the first sealing ring 136', it should be understood that the second sealing ring 138' can alternatively be located forward of the first sealing ring 136'.

The inner platform surface 114 of the platform 90 may define a single recess 160 extending axially from the first mount 92A to the second mount 92B and circumferentially along the platform 90. The axially-extending portion 140 of the first sealing ring 136 and the axially-extending surface 154 of the second sealing ring 138' may be in contact with the inner platform surface 114 within the recess 160, when the rotor blade 58 is fully installed in the rotor disk 60 (see, e.g., FIG. 17). The first sealing ring 136' and the second sealing ring 138' may axially overlap one another, when the rotor blade 58 is fully installed in the rotor disk 60 (see, e.g., FIG. 17). As a result of the wedge surfaces 158, 162, centrifugal loads applied to the first and second sealing rings 136, 138', during rotational of the rotor disk 60, may translate into axial forces acting on the first and second sealing rings 136', 138' in an axially-forward direction and an axially-aft direction, respectively. The axial forces applied to the first and second sealing rings 136', 138' may serve to axially retain the rotor blades 58 in a properly installed position with respect to the rotor disk 60.

Referring to FIGS. 12-18, a method 1800 for assembling a rotor assembly for a piece of rotational equipment is provided. In Step 1802, the seal 130 is inserted into the cavity 128. In Step 1804, the first and second sealing rings 136, 136', 138, 138' are axially compressed (i.e., forced axially closer to one another) and radially compressed (i.e., forced radially inward inside the cavity 128) (see, e.g., FIGS. 12 and 15). In Step 1806, the rotor blade 58 is radially inserted into the rotor disk 60 (i.e., the rotor blade 58 is inserted with respect to the rotor disk 60 such that the rotor blade 58 and the rotor disk 60 axially overlap) (see, e.g., FIGS. 12 and 15). Radial insertion of the rotor blade 58 into the rotor disk 60 may provide the radial compression of the first and second sealing rings 136, 136', 138, 138' discussed with respect to Step 1804. For example, the first and second sealing rings 136, 136', 138, 138' may be radially compressed between the outer diameter surface 66 and the inner platform surface 114. In Step 1808, the rotor blade 58 is axially inserted into the rotor disk 60 such that the first mount 92A of the rotor blade 58 is inserted into the first mount slot 84A and the second mount 92B of the rotor blade 58 is inserted into the second mount slot 84B (see, e.g., FIGS. 13-14 and 16-17). As the rotor blade 58 is axially inserted into the rotor disk 60, the first sealing ring 136, 136' and the second sealing ring 138, 138' may move away from one another in an axial direction into their respective, properly installed positions with respect to the rotor disk 60 (see, e.g., FIGS. 14 and 17).

According to embodiments of the present disclosure, the circumferentially-extending cavity 128 defined in the rotor disk 60 provides suitable space to enclose a leakage restriction device such as the seal 130. The seal 130 may reduce or prevent fluid leakage axially through the interface between the rotor blade 58 and the rotor disk 60 as well as radially between circumferentially adjacent rotor blades 58. The seal 130 may further promote axially retention of the rotor blade 58 mounted within the rotor disk 60 and may provide vibration dampening to the rotor blades 58.

No claim element herein is to be construed under the provisions of 35 U.S.C. 112(f) unless the words "means for" or "step for" are explicitly used in the particular claim.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

What is claimed is:

1. A rotor assembly for a piece of rotational equipment, the rotor assembly comprising:

a rotor disk configured to rotate about a rotational axis, the rotor disk comprising a first rotor attachment member comprising a first mount slot and a second rotor attachment member comprising a second mount slot, the rotor disk further comprising an outer diameter surface extending between the first rotor attachment member and the second rotor attachment member;

a rotor blade comprising an airfoil, a platform, a first mount retained within the first mount slot, and a second mount retained within the second mount slot, the platform comprising an inner platform surface facing the outer diameter surface of the rotor disk, wherein the rotor disk and the rotor blade define a circumferential portion of a circumferentially-extending cavity between the inner platform surface, the outer diameter surface of the rotor disk, the first rotor attachment member, and the second rotor attachment member; and a seal disposed within the circumferentially-extending cavity, the seal comprising at least one sealing ring disposed about the rotational axis, the at least one sealing ring in contact with the inner platform surface of the platform and radially spaced from the outer diameter surface of the rotor disk.

2. The rotor assembly of claim 1, wherein each of the first rotor attachment member and the second rotor attachment member extend radially outward from the outer diameter surface of the rotor disk to respective first and second distal ends adjacent the inner platform surface of the platform.

3. The rotor assembly of claim 2, wherein the first mount slot and the second mount slot extend a first radial distance from the respective first and second distal ends toward the outer diameter surface of the rotor disk and wherein the first mount slot and the second mount slot are spaced from the outer diameter surface of the rotor disk by a second radial distance.

4. The rotor assembly of claim 1, wherein the circumferentially-extending cavity comprises an axial width extending from the first rotor attachment member to the second rotor attachment member and a radial height extending from the outer diameter surface of the rotor disk to the inner platform surface of the platform.

5. The rotor assembly of claim 1, wherein the at least one sealing ring is biased in a radially outward direction.

6. The rotor assembly of claim 1, wherein the at least one sealing ring is in contact with a cavity-facing surface of one or both of the first rotor attachment member and the second rotor attachment member.

7. The rotor assembly of claim 1, wherein the at least one sealing ring comprises a first sealing ring and a second sealing ring axially adjacent the first sealing ring.

8. The rotor assembly of claim 7, wherein the first sealing ring is axially spaced from the second sealing ring.

9. The rotor assembly of claim 8, wherein the inner platform surface of the platform comprises two axially-adjacent recesses, the first sealing ring disposed in a first recess of the two axially-adjacent recesses and the second sealing ring disposed in a second recess of the two axially-adjacent recesses.

10. The rotor assembly of claim 7, wherein the first sealing ring and the second sealing ring axially overlap one another.

11. The rotor assembly of claim 10, wherein the inner platform surface of the platform includes a recess extending axially between the first mount and the second mount, the first sealing ring and the second sealing ring disposed in the recess.

12. A compressor for a gas turbine engine, the compressor comprising:

a stator assembly comprising at least one circumferential row of stator vanes;

a rotor assembly configured to rotate relative to the stator assembly about a longitudinal centerline of the gas turbine engine, the rotor assembly comprising:

a rotor disk comprising a first rotor attachment member comprising a first mount slot and a second rotor attachment member comprising a second mount slot, the rotor disk further comprising an outer diameter surface extending between the first rotor attachment member and the second rotor attachment member;

a rotor blade comprising an airfoil, a platform, a first mount retained within the first mount slot, and a second mount retained within the second mount slot, the platform comprising an inner platform surface facing the outer diameter surface of the rotor disk, wherein the rotor disk and the rotor blade define a circumferential portion of a circumferentially-extending cavity between the inner platform surface, the outer diameter surface of the rotor disk, the first rotor attachment member, and the second rotor attachment member; and a seal disposed within the circumferentially-extending cavity, the seal comprising at least one sealing ring disposed about the rotational axis, the at least one sealing ring in contact with the inner platform surface of the platform and radially spaced from the outer diameter surface of the rotor disk;

wherein each of the first rotor attachment member and the second rotor attachment member extend radially outward from the outer diameter surface of the rotor disk to respective first and second distal ends adjacent the inner platform surface of the platform, wherein the first mount slot and the second mount slot extend a first radial distance from the respective first and second distal ends toward the outer diameter surface of the rotor disk, and wherein the first mount slot and the second mount slot are spaced from the outer diameter surface of the rotor disk by a second radial distance.

13. The compressor of claim 12, wherein the at least one sealing ring comprises a first sealing ring and a second sealing ring axially adjacent the first sealing ring.

14. A method for assembling a rotor assembly for a piece of rotational equipment, the method comprising:

radially inserting a rotor blade into a rotor disk comprising a first rotor attachment member comprising a first mount slot and a second rotor attachment member comprising a second mount slot, the rotor disk further comprising an outer diameter surface extending between the first rotor attachment member and the second rotor attachment member; and axially inserting a first mount of the rotor blade into the first mount slot and a second mount of the rotor blade into the second mount slot, the rotor blade comprising an airfoil and a platform comprising an inner platform surface facing the outer diameter surface;

wherein the rotor disk and the rotor blade define a circumferential portion of a circumferentially-extending cavity between the inner platform surface, the outer diameter surface, the first rotor attachment member, and the second rotor attachment member, the method further comprising:

inserting a seal into the circumferentially-extending cavity before the step of radially inserting the rotor blade into the rotor disk, the seal comprising a first sealing ring and a second sealing ring axially adjacent the first sealing ring within the circumferentially-extending cavity.

15. The method of claim 14, further comprising axially and radially compressing the first sealing ring and the second sealing ring after the step of inserting the seal into the circumferentially-extending cavity and before the step of radially inserting the rotor blade into the rotor disk.

* * * * *